United States Patent [19]

Finck, Jr. et al.

[11] 4,415,190

[45] Nov. 15, 1983

[54] LOCKABLE RING ASSEMBLY FOR ELECTRIC METER

[75] Inventors: Frederick P. Finck, Jr.; Timothy B. Ely, both of Fairfield, Conn.

[73] Assignee: Highfield Mfg. Company, Div. of Clarkson Industries, Inc., Bridgeport, Conn.

[21] Appl. No.: 251,272

[22] Filed: Apr. 6, 1981

[51] Int. Cl.[3] ..... E05C 19/18

[52] U.S. Cl. ..... 292/256.6; 292/327

[58] Field of Search ..... 292/256.6, 327, 302, 292/252; 70/9

[56] References Cited

U.S. PATENT DOCUMENTS

| | | | |
|---|---|---|---|
| 815,558 | 3/1906 | Rosier | 292/256.6 S X |
| 2,345,269 | 3/1944 | Lackey | 175/222 |
| 3,861,180 | 1/1975 | Hackrotte, Sr. et al. | 70/164 |
| 3,867,822 | 2/1975 | Morse et al. | 70/164 |
| 3,928,990 | 12/1975 | Stenz | 70/232 |
| 4,008,585 | 2/1977 | Lundberg | 70/164 |
| 4,226,102 | 10/1980 | Mattress, Jr. | 292/256.6 X |
| 4,254,647 | 3/1981 | Finck, Jr. | 70/9 X |

*Primary Examiner*—Richard E. Moore

*Attorney, Agent, or Firm*—Cifelli, Frederick & Tully

[57] ABSTRACT

A lockable ring assembly for securing an electric meter in a meter box comprises a split ring having a U-shaped cross section, a keeper stud mounted to the split ring on one side of the joint thereof, and a lock housing mounted to the split ring on the other side of the joint thereof, the lock housing defining a keeper stud opening for receiving the keeper stud and a lock receiving opening for removably receiving a barrel lock. The keeper stud and lock receiving openings intersect, and the keeper stud has a notch providing clearance for inserting the barrel lock in the lock receiving opening, whereby the barrel lock engages the keeper stud to hold the ring closed. The split ring is preferably formed in two semi-circular ring parts joined by a hinge for articulated opening and closing action during installation and removal.

12 Claims, 6 Drawing Figures

LOCKABLE RING ASSEMBLY FOR ELECTRIC METER

BACKGROUND OF THE INVENTION

This invention relates to a lockable ring assembly for securing an electric meter in an associated meter box, thereby preventing theft of electricity through tampering with the installation of the electric meter.

Theft of electricity by tampering with the installation of electric meters is a major problem of electrical utility companies. For many years, an electric meter was secured in its associated meter box by a split ring having a U-shaped cross section for securing the electric meter in the meter box and having radially extending parallel legs which were bolted together to prevent removal of the ring. The legs of the ring were further provided with a wire and an impressed lead seal with the idea that removing the ring to tamper with the electric meter would require disturbing the seal and thereby become evident to personnel of the electric utility company. However, the seal could be released with very little force and often with little evidence of tampering. Thus, there existed a need to lock the electric meter in its meter box rather than merely to seal the mounting device.

Many devices for locking the prior art split ring have been proposed. These devices generally comprise various housing adapted to fit over the radially extending legs of the split ring. The housings receive a barrel lock, which secures the housing from removal and often secures the legs of the split ring together as well. Examples of such devices are found in Morse U.S. Pat. No. 3,867,822, Lundberg U.S. Pat. No. 4,008,585 and Nielsen U.S. Pat. No. 4,158,953. A related device is found in Heckrotte U.S. Pat. No. 3,861,180.

Drawbacks to these prior art locking devices include that they are overly large for the purpose to be accomplished, and are somewhat time consuming to install. Although they are used with a split ring of standard prior art configuration, including the radially extending legs, the split rings must be modified by providing aligned holes in the radially extending legs for receiving either the barrel lock itself or a locking member of the housing. Overall, the prior art locking devices, including a modified split ring, are relatively expensive to manufacture. Thus, none of the prior art devices has solved the problem of locking an electric meter in a totally satisfactory manner.

SUMMARY OF INVENTION

A lockable ring assembly for electric meters according to the invention herein generally comprises a split ring having a U-shaped cross section for embracing the flanges of an electric meter and meter box, the split ring having at least one joint permitting it to be opened, a lock housing mounted to the split ring on one side of the joint thereof, and a keeper stud secured to the split ring on the other side of the joint thereof. The keeper stud is received in the lock housing when the split ring is closed, and a barrel lock is inserted into and locked in a lock-receiving opening defined by the lock housing, the barrel lock operating to retain the keeper stud in the lock housing and thereby lock the split ring in its closed position.

In the preferred embodiment, the split ring is formed in two generally semi-circular parts with an additional joint located generally opposite the joint at which the lock housing and keeper stud are mounted, and the split ring is articulated by hinge means at the additional joint. The articulated split ring may be spread easily for installation over the flanges of the electric meter and meter box, and because the ring itself is not bent to achieve such installation, the ring can be fabricated of stronger metal than was used in prior art split rings. Alternatively, the split ring may have only one joint and be made of sufficiently resilient material that it can be spread for installation over the electric meter and meter box and for inserting the keeper stud in the lock housing concurrent with such installation.

The lock housing is preferably elongated and defines the lock receiving opening generally perpendicular to the plane of the split ring. This permits the barrel lock to be inserted from the front of the electric meter and meter box, and exposes the installed barrel lock for inspection to detect tampering. A seal may be placed at the entrance of the lock receiving opening after the barrel lock is inserted as an added safeguard against tampering. The lock housing defines an additional opening for receiving the keeper stud, and the keeper stud opening preferably intersects the lock receiving opening. The keeper stud includes a notch which defines a portion of the lock receiving opening when the keeper stud is in the lock housing, wherein the barrel lock engages the keeper stud to retain the keeper stud in the lock housing.

Accordingly, it is a principal object of the invention herein to provide improved means for securing an electric meter in its associated meter box.

It is an additional object of the invention herein to provide means which are quickly and easily installed to secure an electric meter in its associated meter box.

It is another object of the invention herein to provide means for securing an electric meter in its associated meter box in a unitary device and which utilizes a standard utility barrel lock.

It is a further object of the invention herein to provide means for securing an electric meter in its associated meter box which is sturdy, resistant to forceful dislodgement, and yet is fabricated of relatively few parts and inexpensive to manufacture.

Other and more specific objects and features of the invention herein will in part be obvious and will in part appear from a perusal of the following description of the preferred embodiments and claims, taken together with the drawings.

DRAWINGS

The same reference numerals refer to the same elements throughout the various Figures.

DESCRIPTION OF PREFERRED EMBODIMENTS

Figure 1:
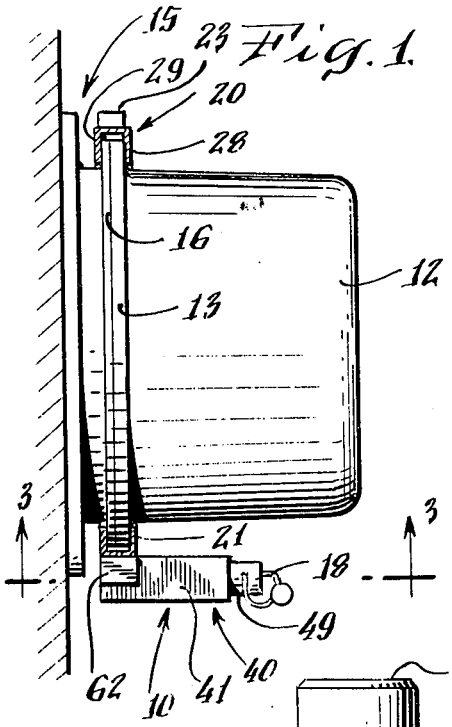
FIG. 1 is a side elevation view, partially in section, of a lockable ring assembly according to the invention herein installed to secure an electric meter in its associated meter box.

With reference to FIGS. 1–5, a lockable ring assembly 10 according to the invention herein generally comprises a split ring 20 formed in two parts which are connected and articulated by a hinge 30, a lock housing 40 adapted to receive a barrel lock 70, and a keeper stud 60 which is received in the lock housing and retained therein by the barrel lock. The lockable ring assembly 10 is utilized to secure an electric meter 12 in a meter box 15.

The split ring 20 is preferably fabricated in two parts 21 and 22, each of the parts comprising approximately one-half of the ring. Thus, the split ring is separated at two diametrically opposed joints 25 and 26 as perhaps best seen in FIGS. 2 and 4. The split ring 20 has a circumferential portion 27 and inwardly extending parallel flanges 28 and 29, whereby the ring has a U-shaped cross section for embracing the adjacent flanges 13 and 16 of the electric meter 12 and meter box 15, respectively.

Figure 2:
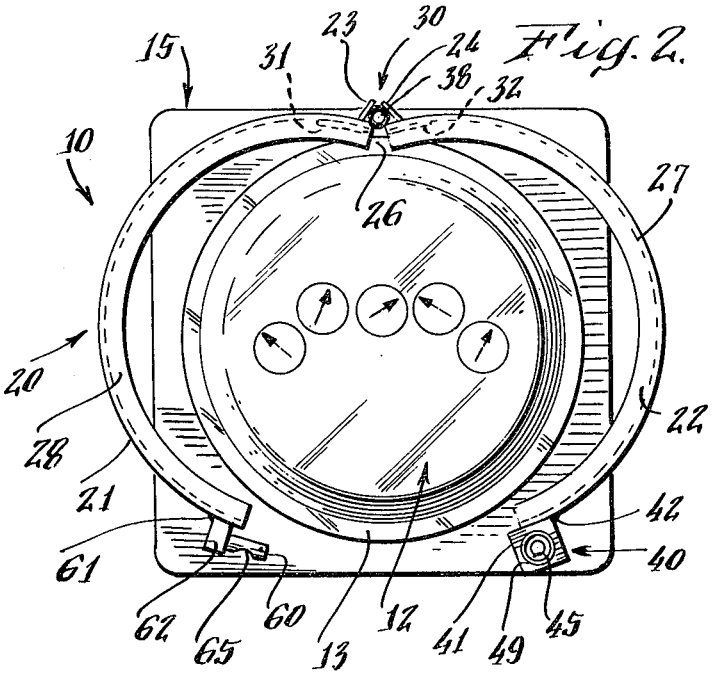
FIG. 2 is a front elevation view of the lockable ring assembly being installed on an electric meter and its associated meter box.
Figure 5:
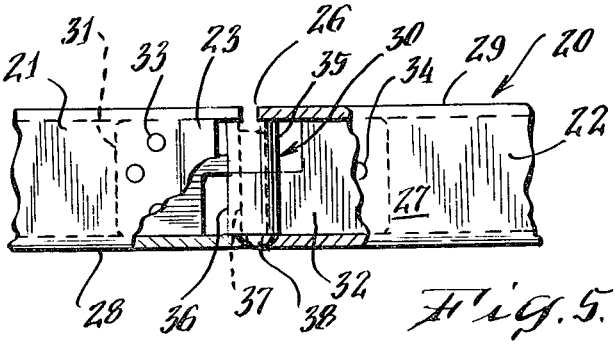
FIG. 5 is a top fragmentary view, partially cut away, of the lockable ring assembly.

As best seen in FIGS. 2 and 5, the two parts 21 and 22 of the split ring 20 are joined together for articulated movement by the hinge 30. The hinge 30 comprises two hinge plates 31 and 32 which are respectively spot welded to the ring parts 21 and 22 on opposite sides of the joint 26, the welds being indicated at 33 and 34. The hinge plates 31 and 32 are disposed under the circumferential surface 27 of the ring, where they are safe from prying or other forceful attack. The hinge plates are respectively formed into hinge eyes 35 and 36, and a hinge pin 37 is inserted through the interlocked hinge eyes 35 and 36. In order to protect the hinge pin 37 from being driven or drilled out of the hinge eyes, the hinge pin is welded at the exterior side of hinge eye 36, the weld being indicated at 38 in FIG. 5. Thus, the hinge pin 37 is held fixed with respect to the hinge eye 36, but is free to pivot within the hinge eye 35. The weld 38 is made prior to heat treating the lockable ring assembly 10, whereby the weld is hardened and resistant to attack. As further protection for the hinge 30, two barriers 23 and 24 are bent upwardly from the circumferential portion 27 of the ring to overlie a portion of the hinge eyes 36 and 35.

The lock housing 40, comprising an elongated metal block 41 which may be rectangular in cross section, is welded at 42 to the ring part 22 adjacent the joint 25. The lock housing is disposed generally perpendicular to the plane of the split ring 20, and preferably extends beyond the joint 25 between the ring parts 21 and 22 (see FIG. 4) so that the joint 25 is somewhat protected when the split ring is closed. The metal block 41 defines a lock receiving opening 45 which is adapted to receive a standard barrel lock 70. The barrel lock 70 comprises an enlarged head 71, a smaller diameter cylindrical shank 72, and two retractable locking balls 73 and 74. The interior mechanism of the barrel lock, of which several are available in the prior art and are well-known, operates to project the balls 73 and 74 from the shank 72 in a locked position, and to retract the balls 73 and 74 within the shank in an unlocked position. This is accomplished by a key (not shown) which is inserted in an opening in the front face 75 of the barrel lock 70. In order to accommodate the barrel lock 70, the lock receiving opening 45 defined in the metal block 41 comprises an upper cylindrical portion 46 having a diameter sufficient to receive the head 71 of the barrel lock and a lower cylindrical portion 47 having a diameter and length sized to receive the shank 72 of the barrel lock. A larger diameter cylindrical groove 48 is provided at the appropriate position for receiving the locking balls 73 and 74 of the barrel lock 70, whereby the barrel lock is retained in the lock housing 40 upon locking. It should be noted that the axial length of the upper cylindrical portion 46 of the lock receiving opening 45 is greater than the axial length of the head 71 of the lock 70, whereby the lock is recessed in the lock receiving opening 45. More particularly, the metal block 41 may be machined to provide a tubular skirt portion 49 which is positioned above the face 75 of the barrel lock 70 when the barrel lock is in the lock receiving opening 45, and two diametrically opposed slots 51 and 52 are provided in the tubular extension for installing a conventional wire and lead seal, if desired.

Figure 3:
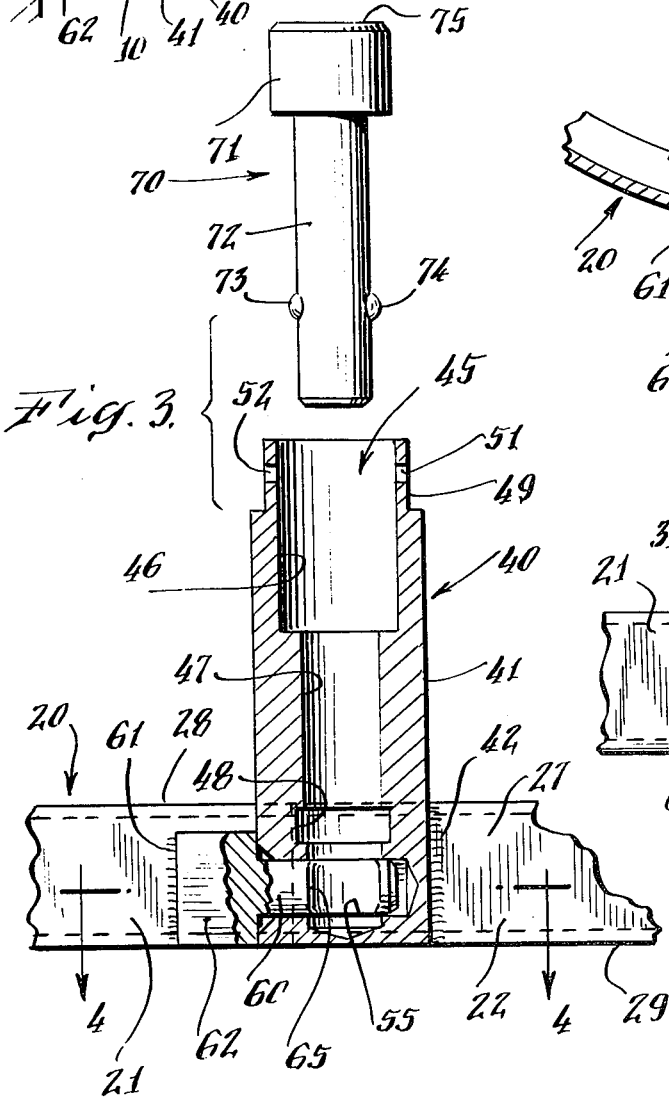
FIG. 3 is a sectional view of the lockable ring assembly taken along the lines 3—3 of FIG. 1, with the barrel lock withdrawn.
Figure 4:
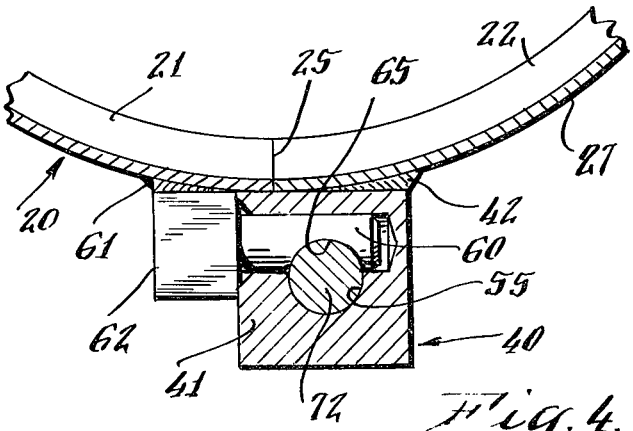
FIG. 4 is a sectional view of the lockable ring assembly taken along the lines 4—4 of FIG. 3.

It will be noted that the lower portion 47 of the lock receiving opening 45 extends beyond the groove 48 to accommodate the full length of the shank 72, and the lock housing 40 further defines a keeper stud opening 55 which partially intersects the lock receiving opening, as best seen in FIGS. 3 and 4. More particularly, the keeper stud opening 55 is disposed generally perpendicular to the lock receiving opening 45, and has its mouth 56 disposed toward ring part 21 of the split ring 20 and the keeper stud 60 mounted thereon. The keeper stud opening 55 is "partially" intersecting with the lock receiving opening 45 in that the keeper stud opening extends across only about one-half of the diameter of the lock receiving opening.

The keeper stud 60 extends from an integral mounting block 62 which is welded to the ring part 21 adjacent joint 25. The weld is indicated at 61, and is best seen in FIG. 4. The keeper stud 60 itself is disposed generally parallel to a line tangent to the split ring 20, and is received in the keeper stud opening 55 in the lock housing 40, that opening also being parallel to a tangent line of the split ring 20. The keeper stud 60 defines a notch 65, the notch 65 being generally cylindrical and being deployed to receive the shank 72 of the barrel lock 70 when the keeper stud and the barrel lock 70 are both received in the lock housing 40. As best seen in FIG. 4, the shank of the barrel lock, being received in the notch 65, engages the keeper stud 60 and thereby prevents the keeper stud from being withdrawn from the lock housing. The keeper stud 60 and the stud receiving opening 55 and the lock housing are preferably cylindrical for ease of fabrication.

The mounting of the lockable ring assembly 10 to the electric meter 12 and associated meter box 15 is best illustrated in FIG. 2. The electric meter 12 is already inserted in the meter box 15 in that figure, and also in FIG. 1, and as is well known in the art, the meter box 15 has a flange 16 lying adjacent a flange 13 of the glass cover of the electric meter 12. The split ring 20 is articulated to the open position shown in FIG. 2, and is fitted over the adjacent flanges 13 and 16 of the electric meter 12 and meter box 15. The split ring 20 is then articulated to its closed position, shown in FIGS. 1 and 4, at which time the keeper stud 60 is inserted into and received in the keeper stud opening 55 of the lock housing 40. The flanges 28 and 29 of the ring 20 embrace the flanges of the electric meter and meter box, thereby securing the electric meter in the meter box. The barrel lock 70 is inserted into the lock receiving opening 45 of the lock housing 40, and locked. As described above, the shank of the barrel lock 70 is received in the notch 65 of keeper stud 60, thereby engaging the keeper stud and preventing the keeper stud 60 from being withdrawn from the lock housing 40. This retains the split ring 20 in its closed position securing the electric meter in the meter box. Also with reference to FIG. 1, it will be noted that although the lock housing 40 protrudes forwardly from the split ring 20, the lock housing 40 is accommodated closely adjacent the glass cover of the electric meter 12, whereby the overall installation is compact. A seal 18 (FIG. 1) is installed through the slots 51 and 52 as a deterrent and detection device against tampering with the barrel lock 70. The installation of the lockable ring assembly 10 takes very little time and is substantially easier than with prior art electric meter locking devices.

Figure 6:
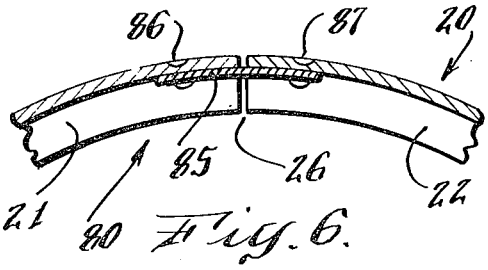
FIG. 6 is a fragmentary sectional view of another lockable ring assembly according to the invention herein.

With reference to FIG. 6, an additional lockable ring assembly 80 according to the invention herein is shown in a fragmentary sectional view. The lockable ring 80 is characterized by hinge means comprising a bendable metal plate 85 which is spot welded to the ring parts 21 and 22, extending across the joint 26 therebetween. The spot welds are indicated at 86 and 87. The metal plate 85 may be a tempered spring steel, which is strong but sufficiently flexible to permit the split ring 20 to be articulated to an open position for installing it over an electric meter. It will be appreciated that the lock housing and keeper stud portions of the lockable ring assembly 80 may be similar to those described above for the lockable ring assembly 10.

Another hinge means, not shown, comprises an elongated C-shaped metal clip inserted through slots in the respective ring parts with the unbroken side of the "C" spanning the joint 26 on the exterior of the ring, thereby holding the ring parts together and providing for their articulated movement. Other hinge means may also be provided by those skilled in the art.

In the articulated embodiments, the ring 20 of the lockable ring assembly can be fabricated of relatively thick gauge hardened steel, inasmuch as the ring articulates rather than bends for fitting it over the electric meter and meter box. As a third embodiment, not shown, the ring 20 may be formed of one circular piece having a single joint at which the lock housing and keeper stud are mounted, the split ring being sufficiently resilient to be spread sufficiently for fitting over the electric meter and meter box, and concurrently to achieve insertion of the keeper stud into the lock housing.

Accordingly, the foregoing describes preferred embodiments of lockable ring assemblies which admirably achieve the objects of the invention herein. It will be appreciated that various changes can be made from the preferred embodiments illustrated and described without departing from the spirit and scope of the invention, which is limited only by the following claims.

We claim:

1. A lockable ring assembly for securing an electric meter in a meter box wherein the electric meter and meter box are of the type having radially outwardly extending flanges disposed adjacent each other when the electric meter is installed in the meter box, the lockable ring assembly comprising:

(A) a split ring having a U-shaped cross section for embracing the adjacent flanges of the electric meter and meter box, the split ring being formed in two substantially semi-circular ring parts and the split ring having a first joint permitting the split ring to be opened for installation over the adjacent flanges of the electric meter and meter box, and a second joint, the ring parts being joined together for articulated opening and closing action by hinge means joining the ring parts across the second joint, the hinge means comprising a bendable metal plate spanning the second joint and welded to the respective ring parts on both sides of the second joint;

(B) a keeper stud mounted to the split ring on one side of the first joint therein; and (C) a lock housing mounted to the split ring on the other side of the first joint therein, the lock housing defining a keeper stud opening for receiving the keeper stud and a lock receiving opening for removably receiving a barrel lock, wherein the keeper stud is received in the keeper stud opening when the split ring is closed, and when a barrel lock is inserted into the lock receiving opening, it retains the keeper stud in the lock housing, thereby preventing the split ring from being opened without removal of the barrel lock.

2. A lockable ring assembly as defined in claim 1 wherein the lock receiving opening defined by the lock housing is perpendicular to the plane of the split ring, whereby the barrel lock is inserted from the front of the electric meter when the lockable ring assembly is installed thereon.

3. A lockable ring assembly as defined in claim 1 wherein the keeper stud is configured to be engaged by the barrel lock when the barrel lock is inserted in the lock housing, where the engagement of the barrel lock with the keeper stud retains the keeper stud in the lock housing.

4. A lockable ring assembly as defined in claim 3 wherein the lock receiving opening defined by the lock housing is perpendicular to the plane of the split ring, whereby the barrel lock is inserted from the front of the electric meter when the lockable ring assembly is installed thereon, and the keeper stud opening is parallel to a line tangent to the split ring and the keeper stud opening partially intersects the lock receiving opening, the keeper stud defining a notch which receives the barrel lock when the barrel lock is inserted into the lock receiving opening, whereby the barrel lock engages the keeper stud to retain the keeper stud in the lock housing.

5. A lockable ring assembly as defined in claim 1 wherein the metal plate is welded to the inside surfaces of the respective ring parts.

6. A lockable ring assembly as defined in claim 5 wherein the lock receiving opening defined by the lock housing is perpendicular to the plane of the split ring, whereby the barrel lock is inserted from the front of the electric meter when the lockable ring assembly is installed thereon, and the keeper stud opening is parallel to a line tangent to the split ring and the keeper stud opening partially intersects the lock receiving opening, the keeper stud defining a notch which receives the barrel lock when the barrel lock is inserted into the lock receiving opening, whereby the barrel lock engages the keeper stud to retain the keeper stud in the lock housing.

7. A lockable ring assembly for securing an electric meter in a meter box wherein the electric meter and meter box are of the type having radially outwardly extending flanges disposed adjacent each other when the electric meter is installed in the meter box, the lockable ring assembly comprising:

(A) a split ring having a U-shaped cross section for embracing the adjacent flanges of the electric meter and meter box, the split ring being formed in two substantially semi-circular ring parts and the split ring having a first joint permitting the split ring to be opened for installation over the adjacent flanges of the electric meter and meter box, and a second joint, the ring parts being joined together for articulated opening nad closing action by hinge means joining the ring parts across the second joint, the hinge means comprising first and second hinge plates respectively welded to the two ring parts, the hinge plates each having at least one integral hinge eye with the hinge eyes of both hinge plates disposed to receive a hinge pin mounted therethrough, the hinge plates being welded to the inside surfaces of the U-shaped ring parts, the hinge eyes extend radially outwardly with respect to the split ring, and portions of the ring parts adjacent the second joint of the split ring are angled outwardly to form barrier tabs over the hinge eyes;

(B) a keeper stud mounted to the split ring on one side of the first joint therein; and (C) a lock housing mounted to the split ring on the other side of the first joint therein, the lock housing defining a keeper stud opening for receiving the keeper stud and a lock receiving opening and removably receiving a barrel lock, wherein the keeper stud is received in the keeper stud opening when the split ring is closed, and when a barrel lock is inserted into the lock receiving opening, it retains the keeper stud in the lock housing, thereby preventing the split ring from being opened without removal of the barrel lock.

8. A lockable ring assembly as defined in claim 7 wherein the end of the hinge pin opposite the meter box when the lockable ring assembly is installed thereon is welded to the surrounding hinge eye in order to protect the hinge pin from being driven or drilled out of the hinge eyes.

9. A lockable ring assembly as defined in claim 8 wherein the keeper stud is configured to be engaged by the barrel lock when the barrel lock is inserted in the lock housing, whereby the engagement of the barrel lock with the keeper stud retains the keeper stud in the lock housing.

10. A lockable ring assembly as defined in claim 9 wherein the lock receiving opening defined by the lock housing is perpendicular to the plane of the split ring, whereby the barrel lock is inserted from the front of the electric meter when the lockable ring assembly is installed thereon, and the keeper stud opening is parallel to a line tangent to the split ring and the keeper stud opening partially intersects the lock receiving opening, the keeper stud defining a notch which receives the barrel lock when the barrel lock is inserted into the lock receiving opening, whereby the barrel lock engages the keeper stud to retain the keeper stud in the lock housing.

11. A lockable ring assembly for securing an electric meter in a meter box wherein the electric meter and meter box are of the type having radially outwardly extending flanges disposed adjacent each other when the electric meter is installed in the meter box, the lockable ring assembly comprising:

(A) a split ring having a U-shaped cross section for embracing the adjacent flanges of the electric meter and meter box, the split ring being formed in two substantially semi-circular ring parts and the split ring having a first joint permitting the split ring to be opened for installation over the adjacent flanges of the electric meter and meter box, and a second joint, the ring parts being joined together for articulated opening and closing action by hinge means joining the ring parts across the second joint, the hinge means comprising first and second hinge plates respectively welded to the two ring parts, the hinge plates each having at least one integral hinge eye with the hinge eyes of both hinge plates receiving a hinge pin therethrough, the end of the hinge pin opposite the meter box when the lockable ring assembly is installed thereon being welded to the surrounding hinge eye in order to protect the hinge pin from being driven or drilled out of the hinge eyes;

(B) a keeper stud mounted to the split ring on one side of the first joint therein; and (C) a lock housing mounted to the split ring on the other side of the first joint therein, the lock housing defining a keeper stud opening for receiving the keeper stud opening when the split ring is closed, and when a barrel lock is inserted into the lock receiving opening, it retains the keeper stud in the lock housing, thereby preventing the split ring from being opened without removal of the barrel lock.

12. A lockable ring assembly for securing an electric meter in a meter box wherein the electric meter and meter box are of the type having radially outwardly extending flanges disposed adjacent each other when the electric meter is installed in the meter box, the lockable ring assembly comprising:

(A) a split ring having a U-shaped cross section for embracing the adjacent flanges of the electric meter and meter box, the split ring having a first joint permitting the split ring to be opened for installation over the adjacent flanges of the electric meter and meter box;

(B) a keeper stud mounted to the split ring one one side of the first joint therein and extending toward the other side of the first joint, said keeper stud being mounted offset from and parallel to a line tangent to the split ring at the first joint thereof, said keeper stud defining a notch;

(C) a barrel lock having a cylindrical shank, an enlarged cylindrical head at one end of said shank, and a pair of locking balls extending outwardly from the shank near the end of the shank opposite the head; and (D) a lock housing mounted to the split ring on the other side of the first joint therein, the lock housing defining a barrel lock receiving opening perpendicular to the plane of the split ring, whereby the barrel lock is inserted from the front of the electric meter when the lockable ring assembly is installed thereon, the lock housing further defining a keeper stud opening parallel to a line tangent to the split ring, the keeper stud opening partially intersecting the barrel lock receiving opening, wherein when the keeper stud is in lock housing, the keeper stud notch is positioned to receive the barrel lock when the barrel lock is inserted into the barrel lock receiving opening, whereby the barrel lock engages the keeper stud to retain the keeper stud in the lock housing and thereby preventing the split ring from being opening without removal of the barrel lock.

* * * * *

UNITED STATES PATENT AND TRADEMARK OFFICE

CERTIFICATE OF CORRECTION

PATENT NO. : 4,415,190

DATED : November 15, 1983

INVENTOR(S) : Frederick P. Finck, Jr.

It is certified that error appears in the above-identified patent and that said Letters Patent is hereby corrected as shown below:

Column 1, line 29, "housing" should read -- housings --. Column 7, line 29, "and" (2nd occurrence) should read read -- for --; Column 8, line 41, "one" (first occurrence) read -- on --; Column 8, line 67, "opening" should read -- opened --.

Signed and Sealed this

*Eighth* Day of *May 1984*

[SEAL]

*Attest:*

GERALD J. MOSSINGHOFF

*Attesting Officer*

*Commissioner of Patents and Trademarks*